US006311625B1

(12) United States Patent
Ostrobrod

(10) Patent No.: US 6,311,625 B1
(45) Date of Patent: Nov. 6, 2001

(54) HORIZONTAL LIFELINE TRAVERSING DEVICE

(76) Inventor: Meyer Ostrobrod, 2070 Bennett Rd., Philadelphia, PA (US) 19116

( * ) Notice: Subject to any disclaimer, the term of this patent is extended or adjusted under 35 U.S.C. 154(b) by 0 days.

(21) Appl. No.: 09/461,583

(22) Filed: Dec. 15, 1999

(51) Int. Cl.[7] ..... B61B 3/00
(52) U.S. Cl. ..... 104/91; 104/115
(58) Field of Search ..... 104/87, 91, 92, 104/112, 115

(56) References Cited

U.S. PATENT DOCUMENTS

| | | | |
|---|---|---|---|
| 1,122,024 | | 12/1914 | O'Connell . |
| 1,429,007 | | 9/1922 | Wilson . |
| 4,265,179 | | 5/1981 | Tupper et al. . |
| 4,313,236 | | 2/1982 | Tupper et al. . |
| 4,352,330 | | 10/1982 | Tupper . |
| 4,458,603 | | 7/1984 | Voecks . |
| 4,459,916 | | 7/1984 | Tupper . |
| 4,462,316 | | 7/1984 | Tupper . |
| 4,470,354 | * | 9/1984 | Tupper ..... 104/93 |
| 4,521,000 | * | 6/1985 | Dodge, Jr. ..... 254/391 |
| 4,584,945 | | 4/1986 | Tupper . |
| 6,125,766 | * | 10/2000 | Flux ..... 104/182 |

* cited by examiner

*Primary Examiner*—S. Joseph Morano
*Assistant Examiner*—Robert J. McCarry, Jr.
(74) *Attorney, Agent, or Firm*—Norman E. Lehrer

(57) ABSTRACT

A load attachment system such as commonly used as a horizontal lifeline safety system includes a substantially horizontal lifeline secured at its ends to a building structure and supported intermittently along its length by intermediate supports. Each support includes a horizontal bar and a partial vertical bar. The system further includes a load attachment device having a pair of grooved rollers that rides on the lifeline. A load is supported from the bottom of a C-shaped member which has its top connected to the rollers thereby allowing the device to traverse the supports. The bottom of the C-shaped member also carries a rotatable paddle wheel which prevents the device from being removed from the line. The paddle wheel rotates when a paddle is engaged by the support's horizontal bar as the device traverses the support.

17 Claims, 3 Drawing Sheets

HORIZONTAL LIFELINE TRAVERSING DEVICE

BACKGROUND OF THE INVENTION

The present invention is directed toward a safety apparatus and more particularly toward a safety apparatus in the form of a load attachment system such as commonly used as a horizontal lifeline. The invention includes a load attachment traversing device that engages the lifeline for movement therealong and which can traverse intermediate supports without detachment from the line.

Horizontal lifelines have been employed for many years to provide fall protection for workers on elevated structures. In fact, such horizontal lifelines are required and have been mandated by safety rules and regulations in many jurisdictions. Such lifelines normally consist of a rope or cable suspended between two structures such as the vertical beams of a building or the like which may be 10, 20 or even 100 feet apart. A safety harness or safety belt is worn by a worker and a lanyard connected to the harness or belt attaches to the horizontal lifeline or cable. The end of the lanyard may include either a loop which can freely move along the length of the lifeline or it may include a grooved roller in the form of a pulley or the like that rolls along the line. This allows the worker to move freely along the length of the lifeline to accomplish his intended tasks. In the event that the worker losses his footing or otherwise falls, the horizontal lifeline, through the lanyard and harness or safety belt will arrest the fall and prevent the worker from suffering injury. The use of such a lifeline is described, for example, in U.S. Pat. Nos. 5,332,071; 5,458,214 and 5,598,900.

In order to function properly, the horizontal lifeline must be sufficiently taught so that the worker's lanyard can easily move across the same and so that the lifeline can function as a steadying rail for the worker, if necessary. However, when the lifeline is sufficiently taught so that the same assumes a linear or substantial linear configuration, the resistance force magnitude required to effectively withstand the load impact of a falling worker becomes theoretically exceedingly large. In the event of a fall, the construction worker ordinarily generates many times his weight in the impact force exerted by the lanyard against the cable or lifeline. Thus, the tension in the lifeline is critical since this determines the amount of sag in a lifeline which, in turn, determines the load amplification by which a vertical fall arrest force applied to the lifeline is multiplied by. Therefore, it is important to know the amount of tension applied to a lifeline. In fact, the amount of tension is frequently dictated by safety rules or regulations in many jurisdictions.

A winch or similar type device is frequently used to tension a horizontal lifeline when the same is in use. The lifeline is normally connected to one anchoring point and then passes through the winch. The winch, in turn, is connected through an anchoring line to the second anchor point. A winch-like device for tightening a horizontal lifeline is described, for example in U.S. Pat. No. 5,957,432 issued to the present applicant, the subject matter of which is incorporated by reference herein.

On short runs of 10 or 20 feet or so, the horizontal lifeline is normally supported only at the ends thereof. With substantially longer runs, however, it frequently becomes necessary to provide intermediate supports to prevent the line from sagging. This creates problems when a worker is attempting to move along the length of the line as the intermediate supports will prevent the loop or pulley at the end of his lanyard from passing. Thus, it would become necessary for the worker to detach his lanyard, move the same to the other side of the intermediate support and then reattach it again. This obviously creates a significant safety hazard.

Devices have been available and proposed in the past which are capable of traversing the intermediate supports. One such device, sold under the name Transfastener by Hy-Safe Technology, of Silver Lake, Wis., is produced by Latchways Ltd., of Wiltshire, England. Similar devices are shown, for example, in U.S. Pat. Nos. 1,122,024; 1,429,007; 4,265,179; 4,462,316 and 4,470,354.

Each of these devices is comprised essentially of an upper portion and a lower portion where one of them is essentially in the form of a rotatable star wheel or the like and the other includes a track adapted to cooperate with the ends of the star wheel. As the device moves along a line, the star wheel is caused to rotate when it engages an intermediate support and the ends of the star wheel roll or slide across a track on the second portion of the device. It is, therefore, the interaction between the ends of the star wheel and the track on the second member which must support the weight should a worker fall or in the event that loads are being transported by the device. This can create excessive wear and ultimately possible failure which could create a safety hazard. In addition, because of the tolerances that are required in ensuring that the ends of the star wheel properly meet with the second portion of the device, these products can be expensive to produce and maintain.

SUMMARY OF THE INVENTION

The present invention is designed to overcome the deficiencies of the prior art discussed above. According to the invention, a load attachment system such as commonly used as a horizontal lifeline safety system includes a substantially horizontal lifeline secured at its ends to a building structure and supported intermittently along its length by intermediate supports. Each support includes a horizontal bar and a partial vertical bar. The system further includes a load attachment device having a pair of grooved rollers that rides on the lifeline. A load is supported from the bottom of a C-shaped member which has its top connected to the rollers thereby allowing the device to traverse the supports. The bottom of the C-shaped member also carries a rotatable paddle wheel which prevents the device from being removed from the line. The paddle wheel rotates when a paddle is engaged by the support's horizontal bar as the device traverses the support.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
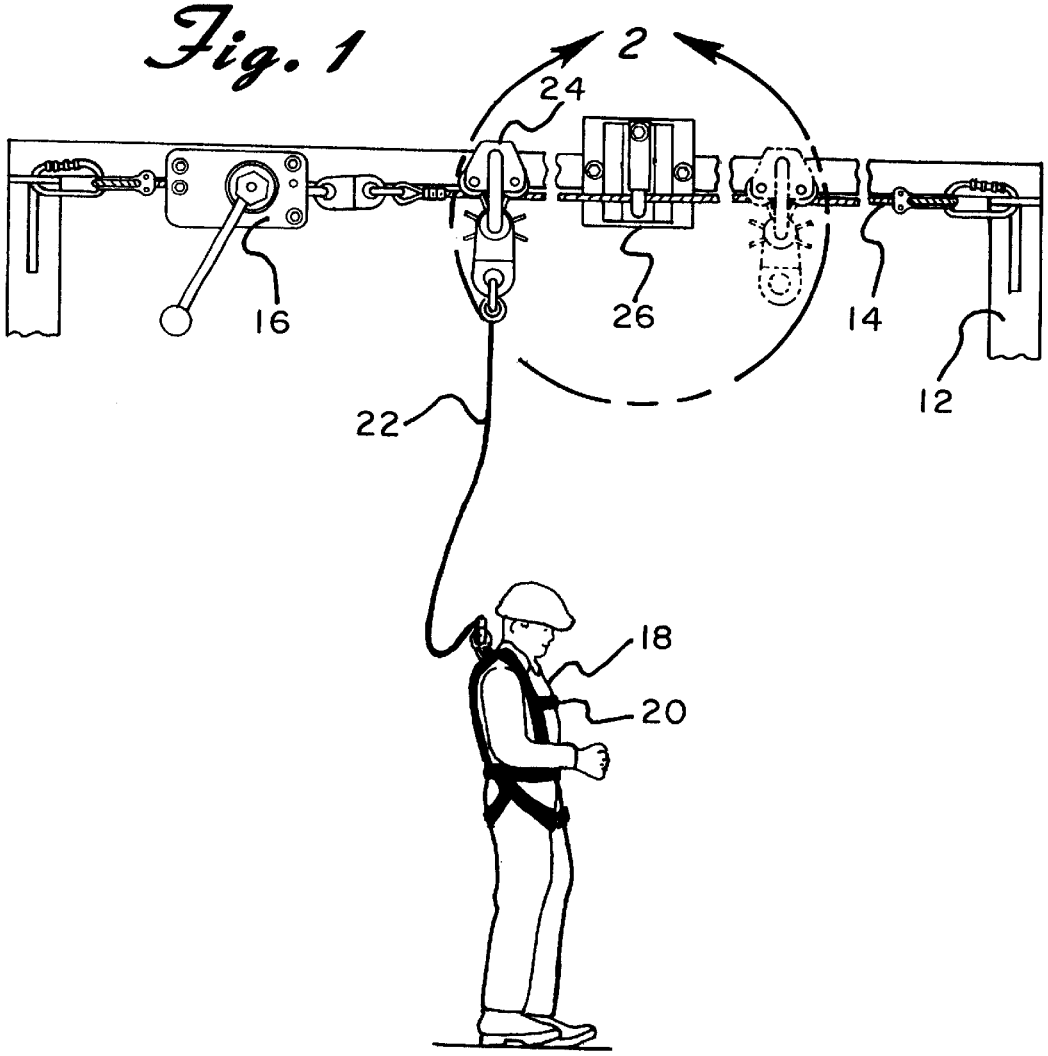
FIG. 1 is a front elevational view showing the overall arrangement of the load attachment system of the invention as installed on a building or other structure.

Referring now to the drawings in detail wherein like reference numerals have been used throughout the various figures to designate like elements, there is shown in FIG. 1 a load attachment system including an elongated substantially horizontal lifeline designated generally as 10. The system is shown connected to a support structure such as a building 12 or the like at each end of the lifeline 14. As is conventional in the art, the lifeline 14 is tensioned utilizing a tensioning device such as shown at 16. A workman 18 wearing a harness 20 is connected to a lanyard 22. The free end of the lanyard 22 is connected to the load attachment traversing device 24 which allows the worker 18 to freely move along the length of the lifeline 14.

Figure 6:
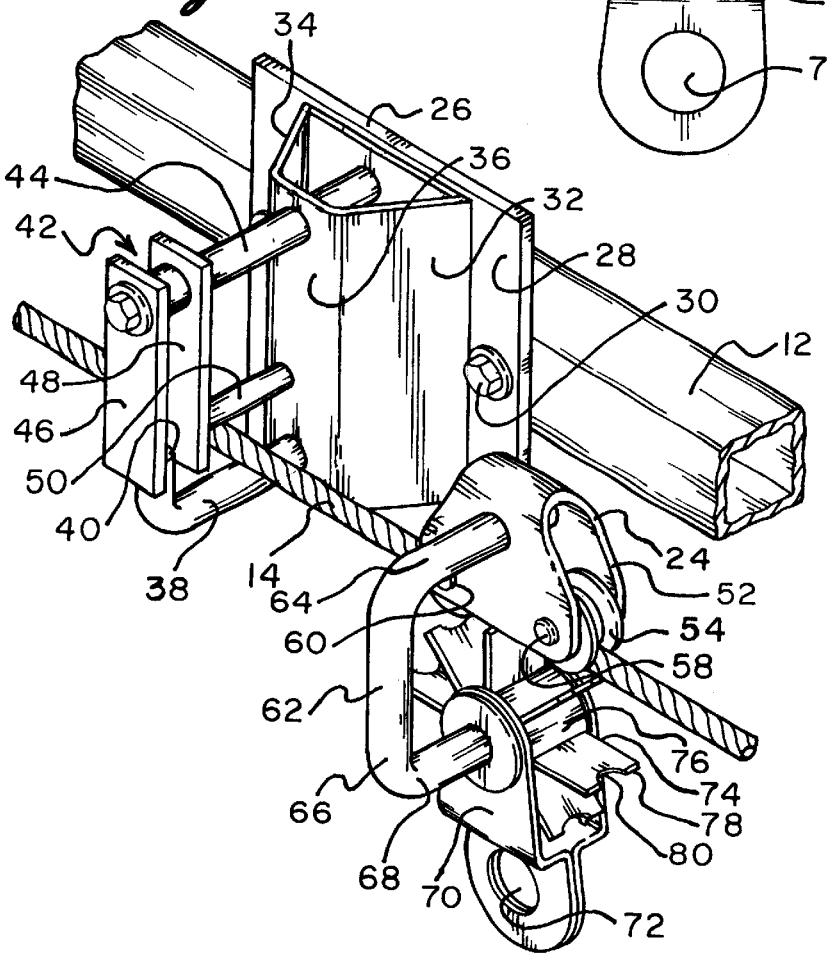
FIG. 6 is a perspective view illustrating the details of the invention.

The lifeline 14 may be a hundred or even several hundred feet long. In order to prevent the same from sagging, one or more support members 26 is intermediately located between the ends of the lifeline. In the preferred embodiment of the invention, the intermediate support members 26, as most clearly shown in FIG. 6, are comprised of a support plate 28 which is used to secure the same to a structural support 12 of the building through the use of bolts 30 or the like. Mounted to the front face of the plate 28 are a pair of vertically extending tapered walls 32 and 34. The forward edges of the tapered walls 32 and 34 are connected by a vertically extending planar wall 36.

Extending forwardly from the front face 36 is a substantially horizontally oriented bar 38. The bar 38 underlies the line 14 and provides vertical support for the line. The forwardmost end of the bar 38 extends vertically upwardly and terminates in an end 40 which preferably lies at a location just above the height of the line 14.

During certain conditions and particularly when there may be activity upstream or downstream along the line 14, it is possible that line 14 could bounce and dislodge itself from its seat on the horizontal bar 38. In order to prevent this, the support member 26 of the invention is provided with a swingable gate system shown generally at 42. The swingable gate system 42 includes a bar 44 extending forwardly of the front surface 36 in substantial vertical alignment with the bar 38 but spaced a distance thereabove. Pivoted to the forward end of the bar 44 are a pair of spaced apart plates 46 and 48. The plates 46 and 48 are mounted so as to swing freely on the bar 44 and are spaced apart from each other a distance which is slightly greater than the thickness of the bar 38. As best seen in FIG. 6, the plates 46 and 48 are just long enough to extend past the upper end 40 of the bar 38 with the plate 46 being located on the outer part of the end 40 while the plate 48 is located adjacent the inner side thereof.

Fixedly secured to the inside surface of the swinging plate 48 is an additional horizontal bar 50. Bar 50 extends inwardly toward the front face 36 of the support 26 but is spaced therefrom and is not secured to the face 36. Rather, bar 50 swings freely with the plate 48. As a result of gravity, the plates 46 and 48 and the bar 50 are normally in their downward position as shown most clearly in FIG. 6. In this position, the bar 50 prevents upward movement of the line 14. This prevents the line 14 from being inadvertently dislodged from the position shown in FIG. 6 wherein it is supported on the bar 38.

The load attachment traversing device 24 of the present invention is also most clearly shown in FIG. 6. It is constructed as a truck or trolley type device which is adapted to freely roll on the upper surface of the line 14. The device is comprised of a frame member 52 which supports a pair of spaced apart grooved rollers 54 which are arranged in tandem. The grooved rollers 54 and 56 are in the form of pulleys or the like and are freely rotatable about axes 58 and 60 carried by the frame member 52.

Extending forwardly from the frame member 52 is a substantially C-shaped member 62 having an open center. The C-shaped member 62 has an upper arm 64 which extends toward and is secured to the frame 52 which carries the rollers 54 and 56. The C-shaped member also includes a substantially vertical portion 66 which extends downwardly to a position below the level of the lower surface of the line 14 and includes a lower arm 68 that extends beneath the arm 14. The lower arm 68 is secured to a lower frame member 70 which has an opening 72 formed at the bottom thereof which allows a workman to attach his lanyard or other load to the same.

Within the lower frame member 70 and freely rotatable about the lower arm 68 of the C-shaped member 62 is a paddle wheel 74. The paddle wheel 74 includes a hub 76 and a plurality of radially spaced apart paddles such as shown at 78. The outer edge of each paddle has a recess such as shown at 80 on paddle 78. The shape of the recess 80 is substantially complementary to the cross-sectional shape of the lower half of the line 14.

As a result of the load attachment traversing device 24 and support member 26 of the present invention, the traversing device 24 can easily ride throughout the length of the line 14 while traversing each of the support members 26. The manner in which this is done should be readily apparent from FIGS. 3, 4, 5 and 6.

Figure 2:
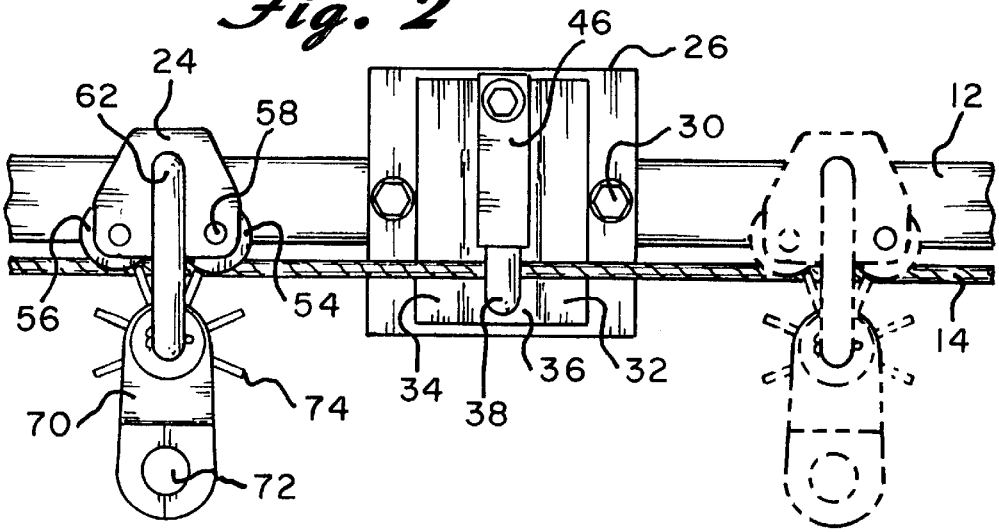
FIG. 2 is an enlarged view showing the details of the area surrounded by the arrow 2 in FIG. 1.
Figure 3:
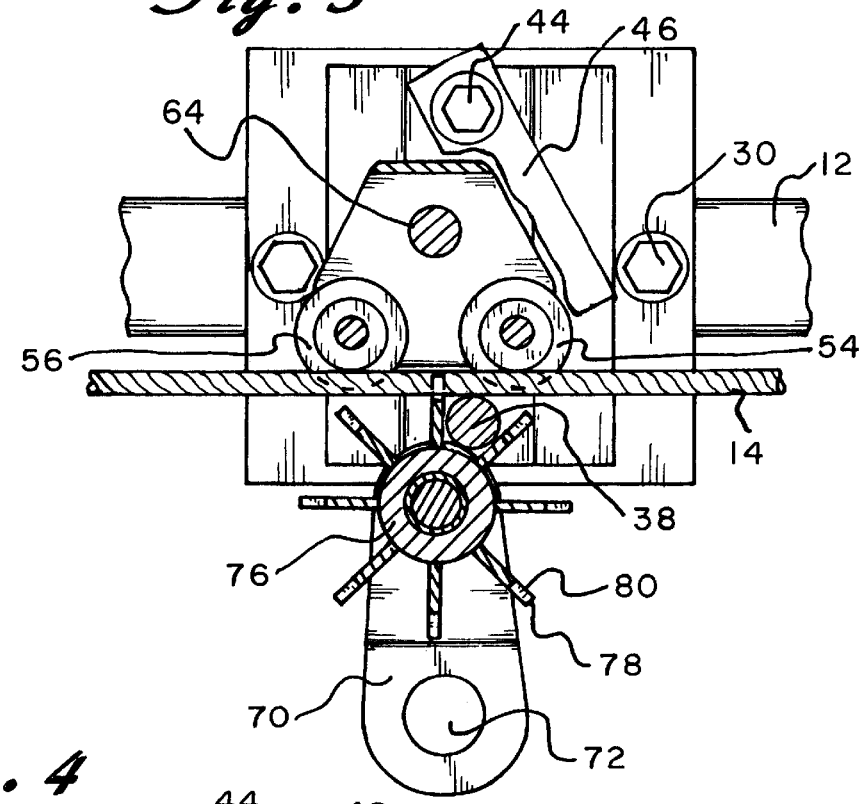
FIGS. 3, 4 and 5 are front elevational views, with sections cut away for clarity, illustrating the sequence of the load transferring device traversing an intermediate support member.
Figure 4:
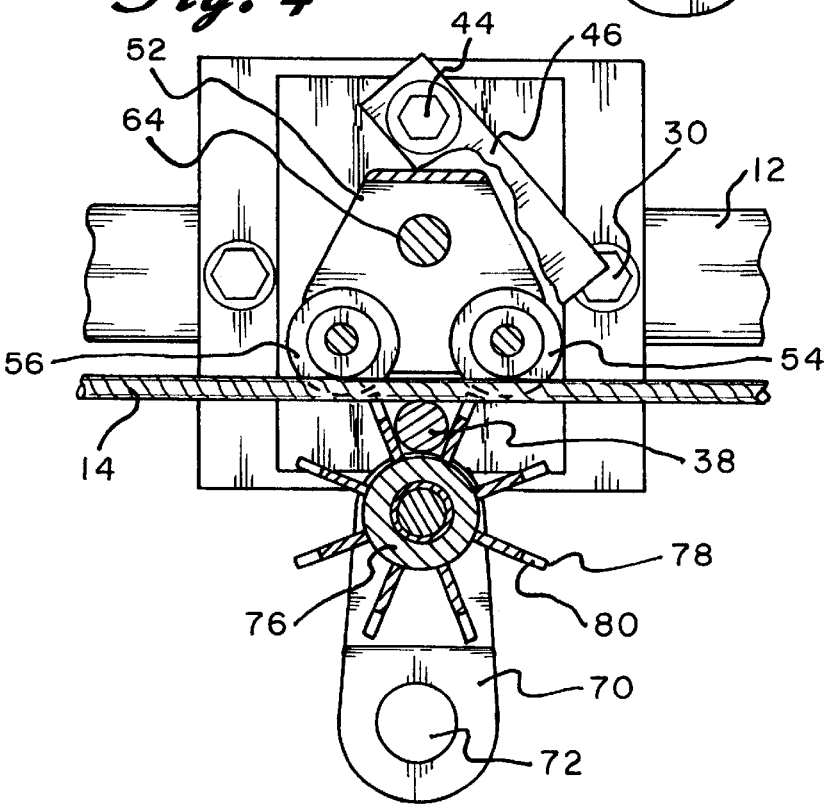
Figure 5:
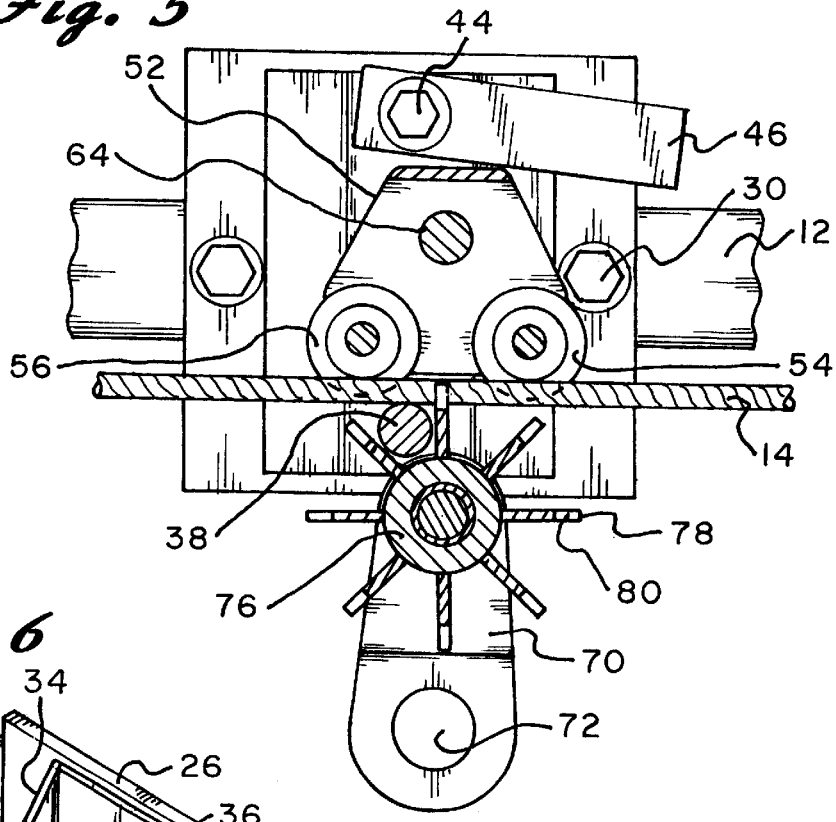

For illustration purposes, it should be presumed that the load traversing device 24 is moving from left to right as shown in FIG. 2. As it approaches the support 26, the forward roller 54 and a forward portion of the frame 52 begin to extend beneath the bar 44. At the same time, the bar 38 enters an opening between two of the paddles 78 in the upper forward portion of the paddle wheel. As the traversing device 24 continues to move to the right, the upper arm 64 will cause the swinging gate 42 to pivot to the right and upwardly as shown in FIGS. 3 and 4. At the same time, the bar 38 will cause the paddle wheel 74 to rotate counterclockwise as shown in FIGS. 3 and 4. As each paddle 78 moves into its vertical position such as shown in FIGS. 3 and 5, the lower portion of the line 14 fits into the recess 80 at the outer edge 78. As the traversing device 24 continues moving to the right, the paddle wheel continues to rotate so that the bar 38 is now on the trailing side of the paddle wheel and the gate 42 is substantially horizontal as shown in FIG. 5. As the traversing device continues on, the gate 42 will eventually fall back into the position shown in FIG. 6.

As should be readily apparent to those skilled in the art from viewing FIGS. 3, 4, 5 and 6, the number and size of the paddles 78 on the paddle wheel 74 are chosen so that the traversing device 24 can never be lifted up off of the line 14. At least one and frequently two paddles of the paddle wheel will always be in a position so as to interfere with the traversing device 24 from being lifted off of the line. As should also be readily apparent, all of the weight suspended from the lower frame member 70 is transferred through the C-shaped member 62 to the rollers 54 and 56. Thus, the paddle wheel 74 does not carry any of the weight but is simply a means for preventing the traversing device 24 from being lifted off of the line 14.

Although the system of the present invention has been described with particular reference to a horizontal lifeline and the ability to prevent injury to a workman who may accidentally fall, it should be readily apparent that the system has a variety of other uses. By way of example and not limitation, it could be used to transport substantially any load along the length of a line which may have intermediate support members.

The present invention may be embodied in other specific forms without departing from the spirit or essential attributes thereof and accordingly, reference should be made to the appended claims rather than to the foregoing specification as indicating the scope of the invention.

I claim:

1. In a load attachment system including an elongated substantially horizontal line secured at its ends to a structure and supported at at least one intermediate point by a support member secured to said structure and a load attachment traversing device engaging said line for movement therealong, said device traversing said support member without detachment from said line, the improvement comprising:

said support member including a bar extending from said structure and underlying said line so as to provide vertical support for the line, said bar having a forward portion extending vertically and having an end located above the height of said line;

said load attachment traversing device including a grooved roller engaging the upper surface of said line for rolling movement along the length thereof;

a substantially C-shaped member having an open center and an upper arm secured to said roller, said C-shaped member further having a substantially vertical portion extending downwardly below the level of the lower surface of said line and including a lower arm extending forwardly beneath said line;

means carried by said lower arm for securing a load to said device, and means carried by said lower arm for preventing said device from vertical movement so that the same cannot be removed from said line.

2. The improvement as claimed in claim 1 wherein said preventing means comprises a rotatable member in the form of a paddle wheel having a plurality of radially spaced apart paddles, said paddles being adapted to rotate when engaged by said bar as said device traverses said support member.

3. The improvement as claimed in claim 1 wherein said support member further includes means for preventing upward movement of said line.

4. The improvement as claimed in claim 1 wherein said support member further includes swinging gate means overlying said end of said forward portion of said bar and terminating adjacent said end.

5. The improvement as claimed in claim 4 wherein said upper arm of said C-shaped member engages said gate means to open the same as said device traverses said support means.

6. The improvement as claimed in claim 5 wherein said support means further includes means for preventing upward movement of said line.

7. The improvement as claimed in claim 6 wherein said means for preventing upward movement of said line is carried by and movable with said gate means.

8. The improvement as claimed in claim 1 wherein said device includes a pair of spaced apart grooved rollers arranged in tandem.

9. The improvement as claimed in claim 8 wherein said preventing means comprises a rotatable member in the form of a paddle wheel having a plurality of radially spaced apart paddles, said paddles being adapted to rotate when engaged by said bar as said device traverses said support member, said paddle wheel being located beneath and between said rollers.

10. The improvement as claimed in claim 2 wherein each of said paddles has an outer edge with a recess therein, the shape of said recess being substantially complementary to the cross-sectional shape of said line.

11. In a load attachment system including an elongated substantially horizontal line secured at its ends to a structure and supported at at least one intermediate point by a support member secured to said structure and a load attachment traversing device engaging said line for movement therealong, said device traversing said support member without detachment from said line, the improvement comprising:

said support member including a bar extending from said structure and cooperating with said line so as to provide vertical support for the line;

said load attachment traversing device including a grooved roller engaging the upper surface of said line for rolling movement along the length thereof;

a substantially C-shaped member having an open center and an upper arm secured to said roller, said C-shaped member further having a substantially vertical portion extending downwardly below the level of the lower surface of said line and including a lower arm extending forwardly beneath said line;

means carried by said lower arm for securing a load to said device, and means carried by said lower arm for preventing said device from vertical movement so that the same cannot be removed from said line.

12. The improvement as claimed in claim 11 wherein said preventing means comprises a rotatable member in the form of a paddle wheel having a plurality of radially spaced apart paddles, said paddles being adapted to rotate when engaged by said bar as said device traverses said support member.

13. The improvement as claimed in claim 12 wherein each of said paddles has an outer edge with a recess therein, the shape of said recess being substantially complementary to the cross-sectional shape of said line.

14. The improvement as claimed in claim 11 wherein said support member further includes means for preventing upward movement of said line.

15. The improvement as claimed in claim 11 wherein said device includes a pair of spaced apart grooved rollers arranged in tandem.

16. The improvement as claimed in claim 15 wherein said preventing means comprises a rotatable member in the form of a paddle wheel having a plurality of radially spaced apart paddles, said paddles being adapted to rotate when engaged by said bar as said device traverses said support member, said paddle wheel being located beneath and between said rollers.

17. The improvement as claimed in claim 16 wherein each of said paddles has an outer edge with a recess therein, the shape of said recess being substantially complementary to the cross-sectional shape of said line.

* * * * *